US006659311B2

(12) United States Patent
Prueter

(10) Patent No.: US 6,659,311 B2
(45) Date of Patent: Dec. 9, 2003

(54) SWIVEL PUMP DISPENSER FOR DISPENSING LIQUID FROM A SELECTED ONE OF PLURALITY OF LIQUID COMPARTMENTS

(75) Inventor: David M. Prueter, Olathe, KS (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 86 days.

(21) Appl. No.: 10/119,071

(22) Filed: Apr. 10, 2002

(65) Prior Publication Data

US 2003/0192913 A1 Oct. 16, 2003

(51) Int. Cl.[7] ..... B67D 5/52

(52) U.S. Cl. ..... 222/136; 222/144.5; 222/383.1; 222/481.5

(58) Field of Search ..... 222/129, 135, 222/136, 144.5, 383.1, 481.5

(56) References Cited

U.S. PATENT DOCUMENTS 4,355,739 A * 10/1982 Vierkotter ..... 222/134
4,549,674 A * 10/1985 Alticosalian ..... 222/48
5,009,342 A * 4/1991 Lawrence et al. ..... 222/136
5,152,431 A 10/1992 Gardner et al. ..... 222/136
5,370,275 A * 12/1994 Mills et al. ..... 222/136
5,385,270 A * 1/1995 Cataneo et al. ..... 222/134
5,433,350 A * 7/1995 Graubart ..... 222/136
5,472,119 A * 12/1995 Park et al. ..... 222/145.8
5,626,259 A * 5/1997 Maas et al. ..... 222/136
5,769,275 A * 6/1998 Boehmer et al. ..... 222/136
5,857,591 A * 1/1999 Bachand ..... 222/1
6,095,377 A 8/2000 Sweeton et al. ..... 222/383.1
6,182,865 B1 * 2/2001 Bunschoten et al. ..... 222/136

* cited by examiner

*Primary Examiner*—Joseph A. Kaufman
(74) *Attorney, Agent, or Firm*—Dykema Gossett PLLC

(57) ABSTRACT

A swivel pump dispenser for dispensing liquid from a selected one of a plurality of liquid compartments arranged side-by-side, includes positive venting to atmosphere of each liquid compartment during dispensing, and the sealing of the liquid compartment vents closed during periods of non-use.

12 Claims, 3 Drawing Sheets

SWIVEL PUMP DISPENSER FOR DISPENSING LIQUID FROM A SELECTED ONE OF PLURALITY OF LIQUID COMPARTMENTS

BACKGROUND OF THE INVENTION

This invention relates generally to a liquid pump dispenser capable of dispensing liquid from a selected one of a plurality of liquid compartments of a single compartmented container or of separate container sections.

Various household and commercial cleaning products are used for a variety of purposes in a room of the home or office requiring a number of separate containers each of which must be dispensed separately. For example, a carpet spot removal is a special product and a wall and floor cleaner is yet another product while a glass cleaner is yet another. All these products must be stored in their on own containers with their own dispensers, causing clutter and frustration. A multi-compartmented container of these different products can be utilized with a single swivel pump dispenser which selects one product at a time upon rotation of the dispenser about its axis. Such reduces the need for separate containers of various household and commercial cleaners with their own dispensers, thereby saving storage space and providing for convenient multi-product dispensing. One such apparatus is known and disclosed by U.S. Pat. No. 5,152,431. A single pump assembly is detachably mounted on a multi-compartmented container and rotates relative thereto to select the liquid to be pumped. An inlet tube of the pump assembly connects to one of several openings of a base plate of the pump assembly, from which a dip tube extends into each compartment, upon dispenser rotation for selecting the product to be dispensed.

One major drawback of such a dispenser is that no provision is made for venting the compartments, so as to replenish each compartment with air upon removal of product during dispensing, to avoid container collapse and hydraulic lock of the pump. Besides, the pump dispenser is coupled to a base plate of the container closure by the provision of spring-biased rivet fasteners permitting the lower end of an inlet tube to be aligned with an opening in the base plate from which a dip tube extends upon dispenser rotation. To effect rotation, the pump body must be lifted against the bias of the spring and rotated. The upper end of each dip tube has annular recesses in which are seated O rings. As the pump is rotated the end of the product inlet tube rides on the top surface of the base plate and then registers with one of the openings therein by snapping into the openings under the urging of the spring. Despite the O ring seals, such an arrangement will leak each time the inlet tube hops from one opening to the next. Besides, there is a tendency to wear the end of the inlet tube and/or the area surrounding the opening with which it is aligned each time the dispenser is rotated to select one of the separately compartmented liquids. This wearing can eventually produce leakage.

SUMMARY OF THE INVENTION

It is therefore an object of the present invention to provide a pump dispenser assembly which is capable of dispensing one of several selected liquids from a multi-compartmented container or from adjoining multi-sectioned separate containers, in a manner which improves upon the drawbacks of the prior art. According to the invention, each of the compartments from which a product is selectively dispensed is positively vented upon pump actuation such that atmospheric air replenishes the dispensed liquid from the compartment to thereby avoid container collapse and hydraulic lock of the pump. Moreover, a base wall of the dispenser assembly has a seal with liquid and vent openings which upon dispenser rotation communicate with a selected pair of liquid and vent openings in the base plate of a cap mounted to the container, from which dip tubes extend into separate container compartments. The seal may be provided on a swivel member, and indexing may be provided as acting between the swivel member and the cap for determining a selected container compartment. The indexing may be in the form of a detent on one of the parts received in a groove located in the other part.

Other objects, advantages, and novel features of the invention will become more apparent from the following detailed description of the invention when taken in conjunction with the accompanying drawings.

DETAILED DESCRIPTION OF THE INVENTION

Figure 1:
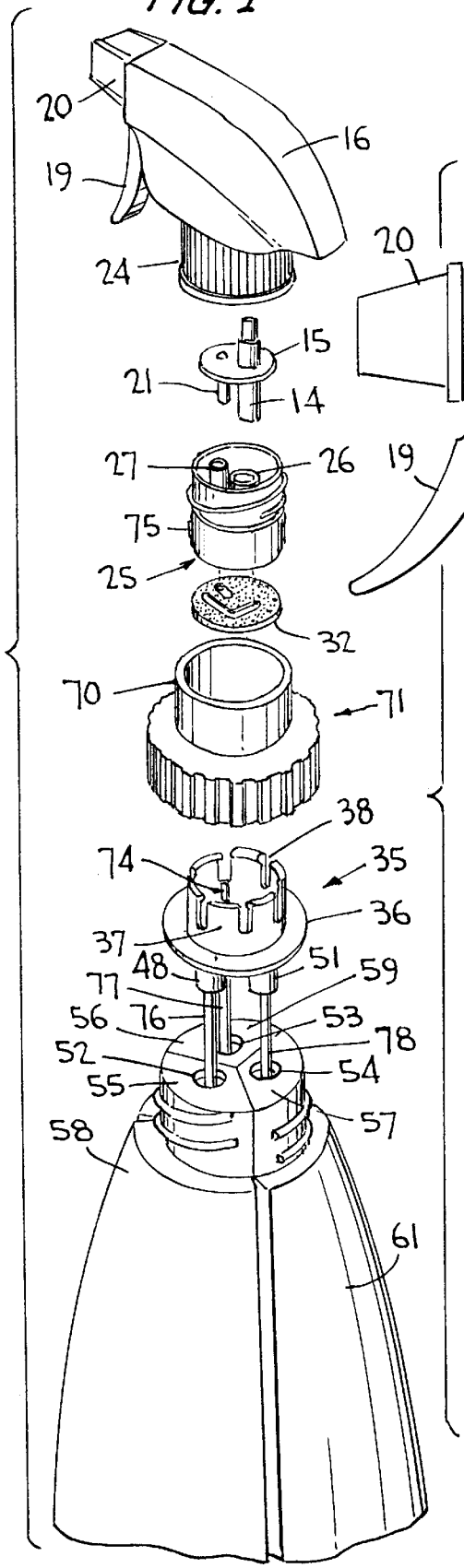
FIG. 1 is an expanded perspective view of the pump dispenser assembly according to the invention shown with adjoining interconnected containers.
Figure 2:
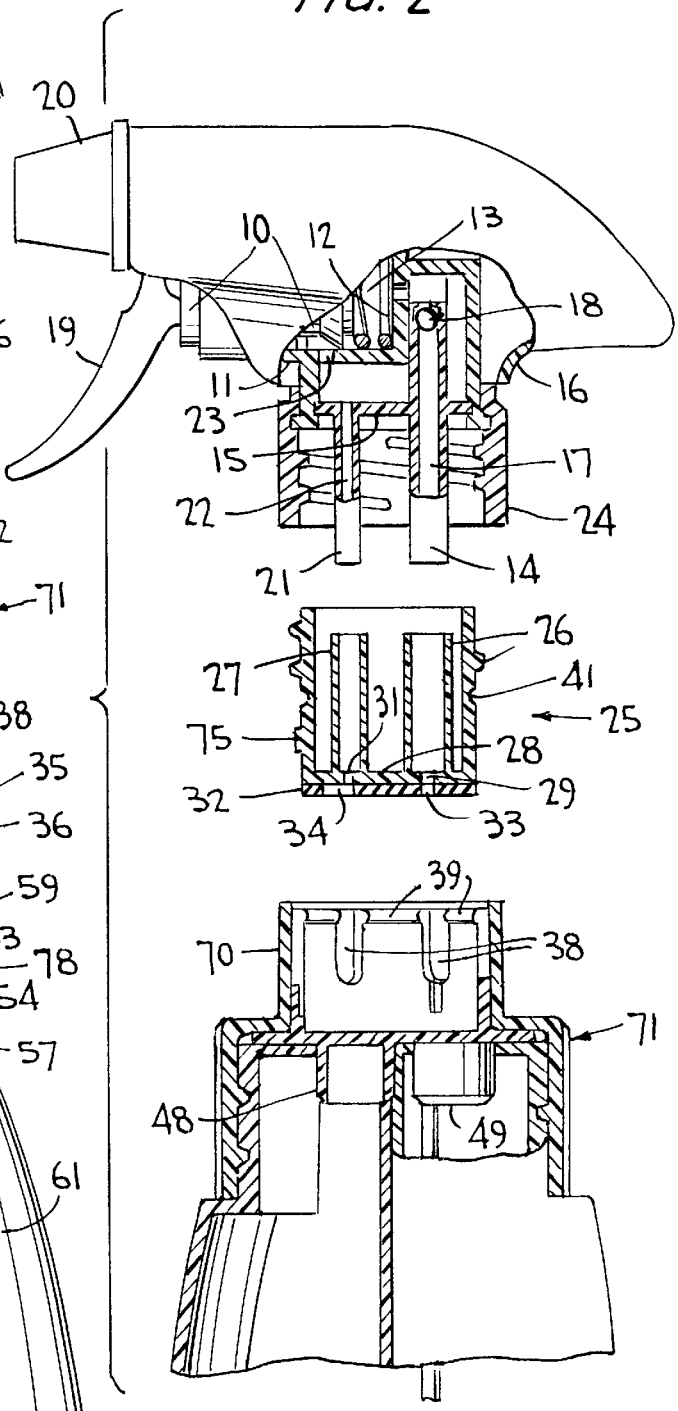
FIG. 2 is a side view, partly in section, of components according to the invention shown in extended view.
Figure 3:
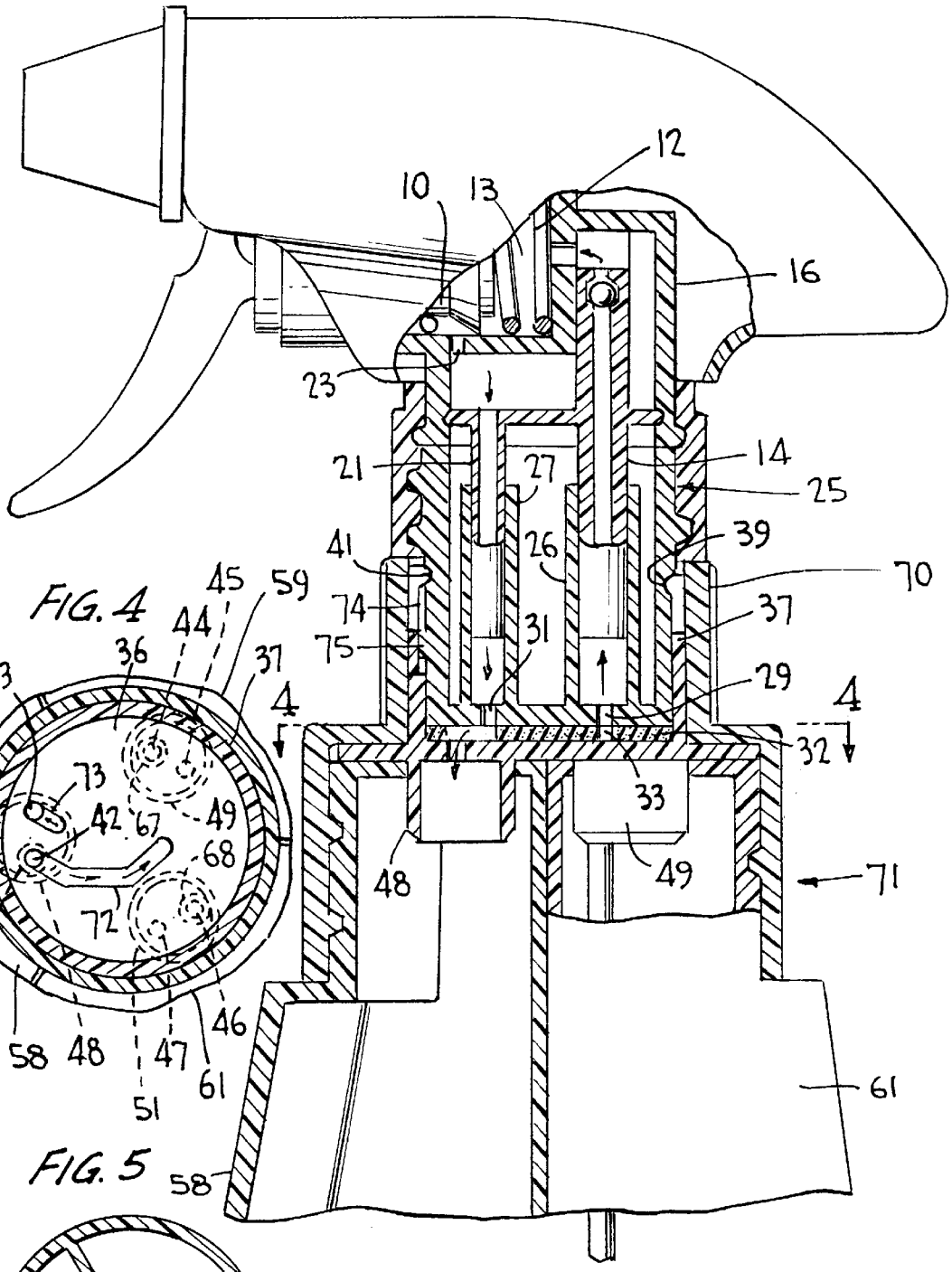
FIG. 3 is a view similar to FIG. 2 showing the various parts of the present assembly assembled together.
Figure 4:
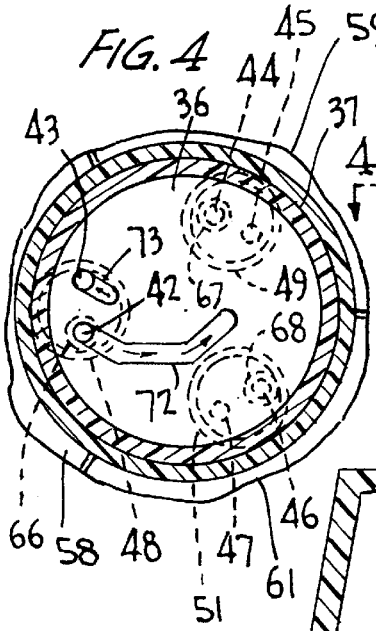
FIG. 4 is a sectional view taken substantially along the line 4—4 of FIG. 3.

Turning now to the drawings wherein like reference characters refer to like and corresponding parts throughout the several views, a swivel pump dispenser assembly according to the invention as shown in FIGS. 1, 2 and 3 includes a known trigger operated pump dispenser of the type disclosed in U.S. Pat. No. 6,095,377, commonly owned herewith, the entirety of which is herein incorporated specifically by reference. The dispenser includes a pump piston 10 operating in a cylinder 11 against the bias of a piston return spring 12 so as to form together with the cylinder a variable volume pump chamber 13. An inlet pipe 14 supported on a disc 15 which may be press-fitted into pump housing 16 supports the inlet pipe which defines an inlet passage 17 valved as at 18 for delivering liquid product into the pump chamber on each return stroke of the piston on relaxation of trigger lever 19. Also supported by disc 15 is a vent pipe 21 which defines a vent passage 22 in communication with a vent port 23 formed in the piston cylinder outboard of chamber 13 and being exposed to atmosphere during each pumping stroke as described in more detail in the aforementioned U.S. Pat. No. 6,095,377 patent.

The pump housing has coupled thereto a container closure 24 which would normally be mounted to a single container of a single product. Instead, closure 24 may be thread coupled to a swivel element 25 having sleeves 26, 27 respectively telescoped with pipes 14, 21 upon coupling, forming air and liquid seals respectively. Base wall 28 of the swivel has a liquid opening 29 formed therein as well as a vent opening 31. Adhered, molded onto, or otherwise secured to the outer face of wall 28 is an elastomeric disc seal 32 having openings 33, 34 therein respectively in alignment with openings 29, 31.

A cap 35 having a base wall 36 has an upwardly extended castellated sleeve 37 formed by cutouts 38 for a purpose to be described hereinafter. An interrupted annular inwardly extending rib 39 is formed at the upper end of sleeve 37 for the reception in annular groove 41 formed in the outer wall of swivel element 25. Base wall 36 of cap 35 has formed therein pairs of openings 42, 43; 44, 45; 46, 47. Openings 42, 44, 46 are liquid openings, and openings 43, 45, 47 are vent openings of the pairs. (See FIGS. 4 and 6 to 8).

Figure 5:
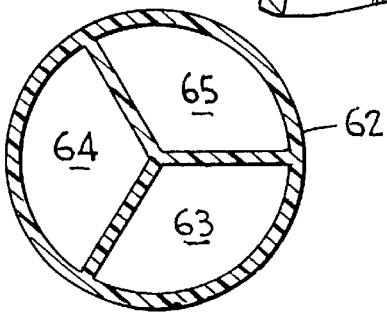
FIG. 5 is a sectional view to the bottle neck of a single container having several compartments.

Short sleeves 48, 49, 51 surround the respective pairs of liquid and vent openings and extend through like sized openings 52, 53, 54 in upper walls 55, 56, 57 of container sections 58, 59, 61 (FIG. 1) each containing a separate liquid product (not shown) to be dispensed with the three sections being coupled together in some typical manner forming no part of the invention. Otherwise, sleeves 48, 49, 51 extend through corresponding openings in a single top wall of a single container 62 (see FIG. 5) formed internally in some manner with separation walls defining compartments 63, 64, 65.

Within sleeves 48, 49, 51 are respectively smaller diameter and shorter tube retention sleeves 66, 67, 68 (FIG. 4) respectively supporting dip tubes 76, 77, 78 each extending into the liquid in the respective containers 58, 59, 61 or in compartments 63, 64, 65 of single container 62.

An internally threaded container closure 71 has an upstanding sleeve 70 through which castellated sleeve 37 extends upon assembly as swivel element 25 is coupled to sleeve 37 and the swivel element is coupled to the pump housing via closure 24. The castellated sleeve 37 thus slightly expands to permit easy reception of swivel element 25 during assembly. The upstanding sleeve of the internally threaded container closure (71) keeps the rib (39) in the annular groove (41) when the closure is placed over the cap (35).

Disc seal 32 has through openings, a liquid opening 33 and a vent opening 34 extending therethrough. Also, a passageway 70 formed in the disc seal either as a groove or as a through opening of irregular configuration as shown, communicates with opening 33. Similarly, a passageway 73, of much shorter length and formed as either a groove in the disc seal or as a through opening, is associated with vent opening 34. As will be described in more detail hereinafter, passageway 72 interconnects one of the liquid openings 42, 44, 46 with liquid opening 33 and with liquid opening 29 of liquid inlet pipe 26 upon rotation of the pump dispenser and its swivel element selectively from FIG. 6 to FIG. 7 to FIG. 8 to FIG. 6.

Indexing is provided for determining the particular liquid to be dispensed upon dispenser rotation. Such indexing may be in the form of one or more vertical grooves 74 (keyways) provided in the inner surface of sleeve 37 for the reception of a detent 75 (key) on the outer wall of swivel element 25. Each groove 74 is associated with one of the liquid openings 42, 44, 46.

In operation, with the dispenser rotatably oriented relative to cap 35 such that openings 33, 34 of disc seal 32 are out of communication directly or indirectly with any of the openings 42 to 47 in cap 35, the openings 42 to 47 are covered by elastomeric disc seal 32 to thereby prevent leakage of product through the vent openings in conditions of non-use, such as during shipping and storage, and in the event the dispenser package is dropped, or tipped or falls on its side. The operator must then choose which of the three liquids stored in containers 58, 59, 61 (or compartments 63, 64, 65 of a single container if that be the case) is selected for dispensing. The operator simply rotates the dispenser about the axis of its closure 24 such that discharge nozzle cap 20 extends into the direction of one of the containers 58, 59, 61 (or one of the sections 63, 64, 65) chosen. The indexing which acts between swivel element 25 and cap 35 confirms the correct orientation of the dispenser relative to the selected container of liquid to be dispensed. Thus at the aforedescribed orientation, for example, with discharge nozzle cap 20 extending into the direction of container 58 (comparable to container section 63), detent 75 will extend into groove 74 located in the inner wall of sleeve 37 in the vicinity of openings 46, 47. At that orientation, shown in FIG. 7, passageway 72 overlies opening 46 from which a dip tube 76 extends as supported by sleeve 68 depending from base wall 36 of cap 35 into the liquid stored in container 58. And, passageway 73 overlies vent opening 47 which communicates with the interior of container 58 (comparably container 53 section). The operator then actuates the pump by pulling on trigger 19 such that during each compression stroke (assuming the pump chamber 12 is primed with liquid) product is discharged through the discharge orifice (not shown) in nozzle cap 20. At each piston compression stroke, vent port 23 in the pump housing is open to atmosphere, as explained in more detail in the U.S. Pat No. 6,095,377, such that the interior of container 58 is vented to atmosphere via pipe 21, vent sleeve 27, vent opening 31, vent opening 34, passageway 73, and vent opening 47 all as in the direction of the downwardly directed arrows shown in FIG. 3. And, while in the FIG. 7 orientation, during each piston suction (return) stroke, liquid product stored in container 58 (comparable to container section 63) is suctioned into pump chamber 12 via dip tube 76, opening 46, passageway 72, opening 33, opening 29, sleeve 26, and inlet pipe 14, in the direction of the upwardly directed arrows seen in FIG. 3.

Figure 6:
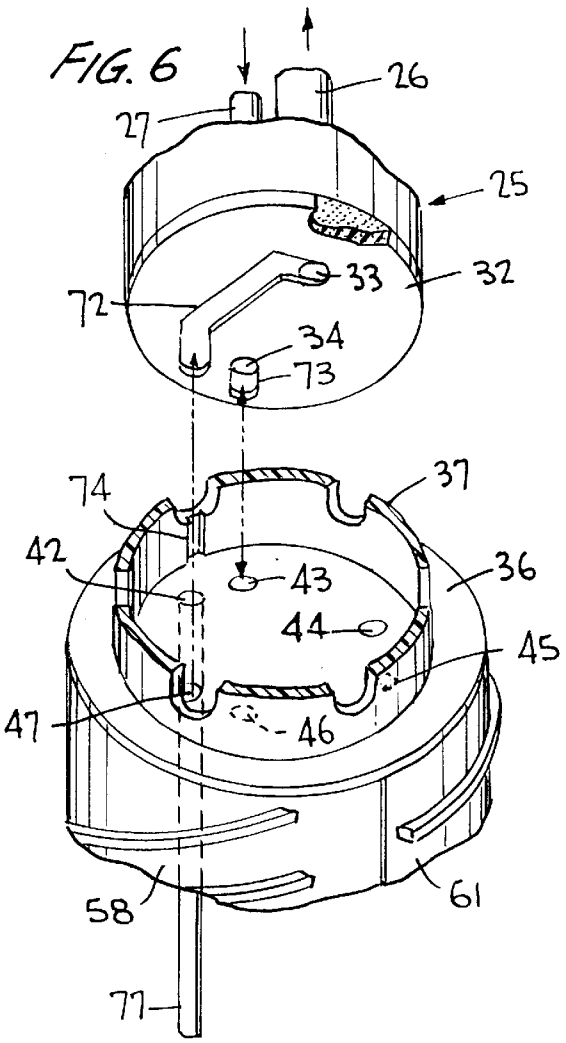
FIG. 6 is an expanded view in perspective of the swivel and cap of the present assembly with the swivel rotated to selectively dispense from one selected compartment.

Assuming the dispenser is oriented such that its forward end lies in the direction of container 59 (comparable to container section 64), as shown in FIG. 6, passageway 72 overlies liquid opening 42, and passageway 73 overlies vent opening 43. During each return stroke of the pump piston upon trigger actuation by the operator, liquid stored in container 59 is suctioned from container 59 via dip tube 77, opening 42, passageway 72, opening 73, sleeve 26, and inlet pipe 14 into the pump chamber, similarly as described with reference to container 58. And, the venting during each ensuing piston compression stroke follows a similar path through 21, 27 and 31 but, compared to that of FIG. 7, continues through vent opening 34, passageway 37, vent opening 43 and into container 59.

Figure 8:
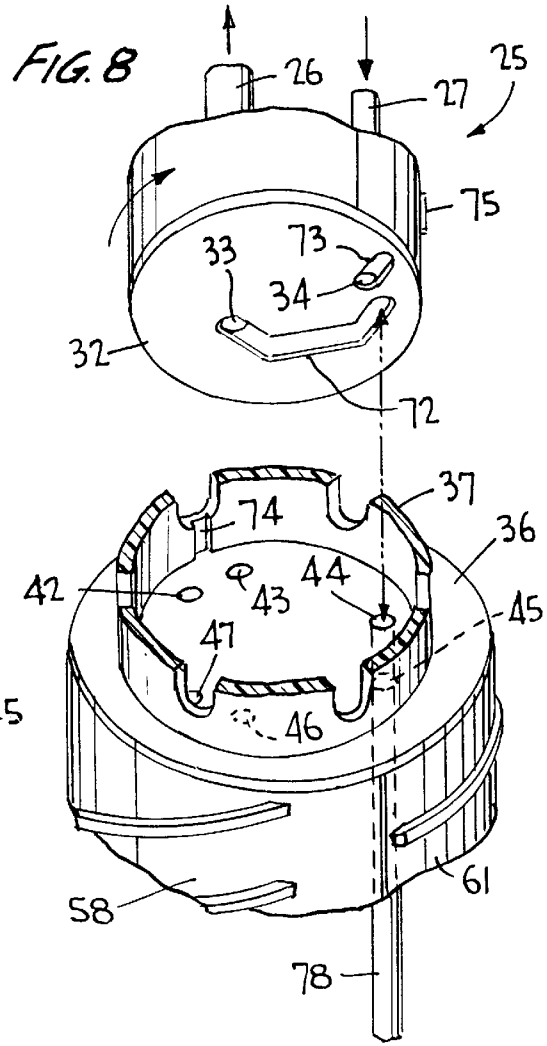
FIG. 8 is a view similar to FIG. 6 showing the swivel rotated to selectively dispense liquid from still a further selected liquid compartment.
Figure 7:
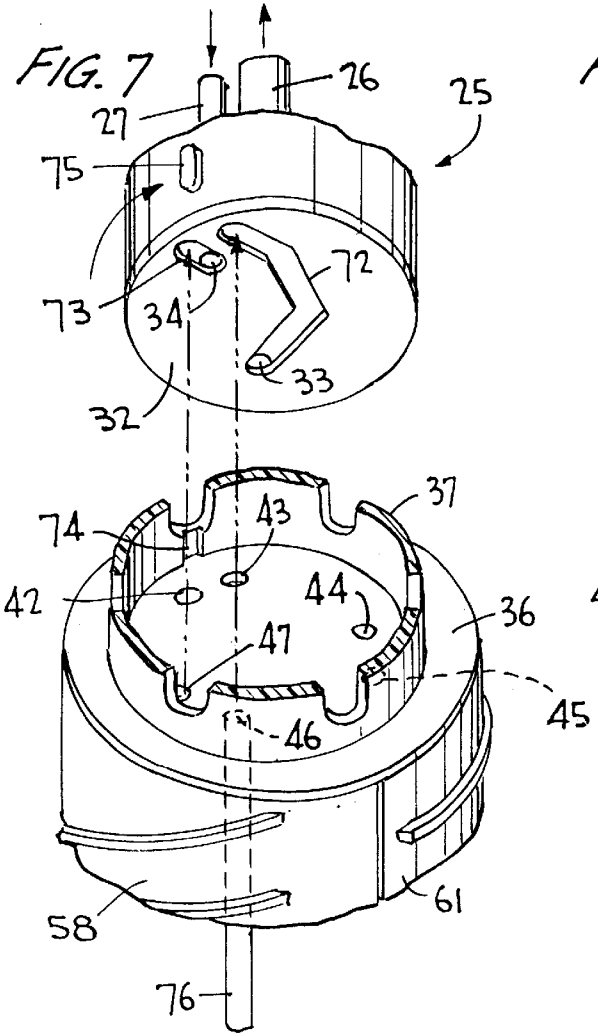
FIG. 7 is a view similar to FIG. 6 with the swivel rotated to selectively dispense from another selected compartment.

Upon orientation of the dispenser such that its discharge nozzle faces in the direction of container 61 (comparable to container section 65), shown in FIG. 8, passageway 72 overlies liquid opening 44, and passageway 73 overlies vent opening 45. Liquid is drawn up from container 61 via dip tube 78 during each piston suction stroke, and through 45, 72, 33, 26 and 14. Venting during each piston compression stroke into container 61 is via 23, 21, 27, 31, 34, 73 and 45.

From the foregoing it can be seen that a simple and economical yet highly effective single pump dispenser package has been devised for selectively dispensing liquids from a multi-compartmented vessel or from adjoining containers in a manner which facilitates positive venting of each container compartment or each container directly to the atmosphere during the pumping of product therefrom. Moreover, in a non-use condition the vents from the containers are sealed closed by an elastomeric seal preventing any leakage during shipping and storage and, in the event the dispensing package is dropped or falls on its side.

Obviously, many modifications and variations of the present invention are made possible in the light of the above teachings. For example, swivel element 25 could be eliminated as a separate element and made unitary with disc 15, without departing from the invention. Also, passageways 72 and 73 in the elastomeric disc can be provided as either through openings as shown or as grooves of irregular configuration. And, pump dispensers having positive container venting of a type other than that disclosed herein, can be utilized as a selective swivel dispenser within the purview of the invention. It is therefore to be understood that within the scope of the appended claims the invention may be practiced otherwise than as specifically described.

What is claimed is:

1. A swivel pump dispenser for dispensing liquid from a selected one of a plurality of liquid compartments arranged side-by-side, comprising a housing including a pump cylinder defining a pump chamber together with a manually reciprocable pump piston, an inlet tube on the housing extending into the pump chamber, a vent port in said chamber in communication selectively with the liquid compartments, the pump housing having means for blocking communication between the vent port and atmosphere in a non-pumping position of the pump and for opening communication between the vent port and atmosphere during pumping, the cap having liquid openings and vent openings each communicating with a separate compartment, dip tubes supported by the cap and each extending into a compartment from the liquid openings, a swivel rotatably coupled to the cap and having liquid and vent passages respectively connected with the inlet tube and the vent port, seal means on the swivel having through openings for selectively connecting one of the liquid openings and one of the vent openings respectively with the inlet tube and the vent port upon rotation of the pump dispenser about the axis of the swivel to selectively dispense liquid from a selected compartment upon operation of the dispenser.

2. The pump dispenser according to claim 1, wherein the seal means comprises a disc seal providing a fluid tight seal between the swivel and a base wall of the cap containing the cap liquid and vent openings, the through openings of the seal means effecting communication between the liquid and vent passages thereof and with only said selected one liquid opening and vent opening.

3. The pump dispenser according to claim 2, wherein said selected one liquid opening and vent opening are paired and are spaced apart a predetermined distance, the liquid and vent passages being spaced apart a distance greater than said predetermined distance, the seal having passageways to effect the communication.

4. The pump dispenser according to claim 1, wherein indexing means acting between the swivel and the cap are provided for indexing the inlet tube and the vent port with the selected one liquid and one vent openings.

5. The pump dispenser according to claim 4, wherein the indexing means comprise a key on the swivel and keyways respectively associated with the liquid openings.

6. The pump dispenser according to claim 1, wherein the swivel and cap are rotatably coupled together by a rib and groove engagement acting therebetween.

7. A swivel pump dispenser coupled to compartmented container means for containing separate liquids, comprising a pump housing having a liquid product inlet to a pumping mechanism and a vent port controlled by pump actuation, a container cap having a base wall containing liquid openings from each of which a dip extends into one compartment of the container means, a container closure retaining the cap to the container means, the base wall of the cap having vent openings, seal means engaging the base wall and being affixed to the housing, the housing and the seal means affixed thereto being rotatable about the central axis of the closure to selectively establish communication between one of the liquid openings and the inlet and one of the vent openings and the vent port, respectively, to dispense from one compartment of the container means at a time.

8. The pump dispenser according to claim 7, wherein the seal means comprises a disc seal having a pair of openings respectively in alignment with the liquid inlet and with the vent port.

9. The pump dispenser according to claim 8, wherein said selected one liquid and vent openings are paired and are spaced apart a distance less than a spacing of said pair of openings, the seal having passageways to effect the communication.

10. The pump dispenser according to claim 7, wherein the container means comprise a plurality of separate container sections.

11. The pump dispenser according to claim 7, wherein the seal means is provided on a base wall of a swivel element, indexing means acting between the swivel and the cap provided for indexing the inlet tube and the vent port with the selected one liquid and vent openings.

12. The pump dispenser according to claim 11, wherein the indexing means comprise a groove on one of the swivel and the cap, and a detent on the other of the swivel and the cap.

* * * * *